US007753084B2

(12) United States Patent
Gielen

(10) Patent No.: US 7,753,084 B2
(45) Date of Patent: Jul. 13, 2010

(54) METHOD FOR CLAMPING A WEFT THREAD IN A JET WEAVING MACHINE, IN PARTICULAR AIR-JET WEAVING MACHINE, CLAMPING DEVICE AND JET WEAVING MACHINE

(75) Inventor: Markus Gielen, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 12/227,775

(22) PCT Filed: Apr. 28, 2007

(86) PCT No.: PCT/DE2007/000769

§ 371 (c)(1), (2), (4) Date: Nov. 25, 2008

(87) PCT Pub. No.: WO2007/140737

PCT Pub. Date: Dec. 13, 2007

(65) Prior Publication Data

US 2009/0288732 A1 Nov. 26, 2009

(30) Foreign Application Priority Data

Jun. 2, 2006 (DE) ..... 10 2006 025 968

(51) Int. Cl.
*D03D 47/30* (2006.01)
*D03D 47/20* (2006.01)
*D03D 41/00* (2006.01)

(52) U.S. Cl. ..... 139/435.1; 139/116.1; 139/435.5; 139/435.2; 139/435.4; 139/435.3

(58) Field of Classification Search ..... 139/116.1, 139/435.1–435.6, 438, 447, 448, 450, 452, 139/453
See application file for complete search history.

(56) References Cited

U.S. PATENT DOCUMENTS 3,367,372 A * 2/1968 Fransen ..... 139/450

(Continued)

FOREIGN PATENT DOCUMENTS

DE 101 07 311 8/2002

(Continued)

*Primary Examiner*—Bobby H Muromoto, Jr.
(74) *Attorney, Agent, or Firm*—W. F. Fasse; W. G. Fasse

(57) ABSTRACT

A method and a clamping device for clamping a weft thread in a jet weaving machine are proposed. The weft thread strand runs through the beginning section (2.1) and the end section (2.2) of a mixing tube. The two sections between themselves form an engagement opening (8) and are connected with a first holding magnet (11) by a counter support (9). An actuator (6) in the form of an elastomeric bellows, which comprises a chamber (10), is located on the beginning section (2.1) of the mixing tube. The chamber (10) is connected to a valve (16) via a supply line (20) and is acted on variably with compressed air. By deformation of the actuator (6), a clamping element (7) connected thereto carries out a tilting movement between the counter support (9) and a contact stop part (19), which contains a second holding magnet (12). The holding magnets (11, 12) lead to an exact and reliable clamping of the weft thread (3).

10 Claims, 3 Drawing Sheets

U.S. PATENT DOCUMENTS

| | | | | | |
|---|---|---|---|---|---|
| 3,532,138 | A | * | 10/1970 | Schlappi | 139/370.2 |
| 3,675,687 | A | | 7/1972 | Vermeulen et al. | |
| 4,190,089 | A | | 2/1980 | Cyvas | |
| 4,476,903 | A | * | 10/1984 | Gunneman | 139/435.4 |
| 4,619,296 | A | | 10/1986 | Hrus et al. | |
| 4,641,688 | A | * | 2/1987 | Gehring | 139/450 |
| 4,643,233 | A | | 2/1987 | Manders | |
| 4,958,664 | A | | 9/1990 | Oppl et al. | |
| 5,107,902 | A | * | 4/1992 | Wahhoud | 139/435.1 |
| 5,386,853 | A | * | 2/1995 | Speich | 139/1 C |
| 5,398,731 | A | * | 3/1995 | Schuster | 139/194 |
| 5,417,250 | A | | 5/1995 | Markey | |
| 5,526,850 | A | | 6/1996 | Sora et al. | |
| 5,697,405 | A | | 12/1997 | Dornier et al. | |
| 6,058,980 | A | * | 5/2000 | Scari et al. | 139/302 |
| 6,109,309 | A | | 8/2000 | Dornier et al. | |
| 6,119,733 | A | | 9/2000 | Arndt et al. | |
| 6,148,872 | A | * | 11/2000 | Wahhoud et al. | 139/435.1 |
| 6,983,771 | B2 | | 1/2006 | Halvarsson et al. | |
| 7,156,337 | B2 | | 1/2007 | Halvarsson et al. | |
| 7,178,560 | B2 | | 2/2007 | Bamelis et al. | |
| 7,191,804 | B2 | | 3/2007 | Bamelis et al. | |
| 7,537,029 | B2 | * | 5/2009 | Gielen et al. | 139/435.1 |
| 2003/0183297 | A1 | * | 10/2003 | Scari et al. | 139/448 |
| 2004/0154685 | A1 | * | 8/2004 | Bamelis et al. | 139/447 |
| 2005/0145290 | A1 | * | 7/2005 | Jacobsson et al. | 139/450 |
| 2005/0284533 | A1 | * | 12/2005 | Verclyte | 139/448 |
| 2007/0095418 | A1 | | 5/2007 | Halvarsson et al. | |
| 2008/0156390 | A1 | * | 7/2008 | Gielen et al. | 139/435.4 |

FOREIGN PATENT DOCUMENTS

| | | |
|---|---|---|
| DE | 102 44 694 | 4/2004 |
| DE | 102 57 035 | 6/2004 |
| DE | 102004036996 | 12/2005 |
| JP | 2000-119936 | 4/2000 |

* cited by examiner

METHOD FOR CLAMPING A WEFT THREAD IN A JET WEAVING MACHINE, IN PARTICULAR AIR-JET WEAVING MACHINE, CLAMPING DEVICE AND JET WEAVING MACHINE

FIELD OF THE INVENTION

The invention relates to a method for clamping a weft thread in a jet weaving machine, especially an air-jet weaving machine. The invention further relates to a clamping device on a weaving machine, especially an air-jet weaving machine. Finally the invention also relates to a jet weaving machine.

BACKGROUND INFORMATION

The prior art is represented by DE 10 2004 036 996 B3. According to that, an apparatus for inserting a weft thread into the loom shed is provided on a jet weaving machine, which apparatus consists of a block of main blown nozzles with connected mixing tubes. In each mixing tube there is provided a clamping device by which the weft thread located in the mixing tube is held in a straight oriented manner before its insertion into the loom shed. Each one of these clamping devices comprises an actuator located outside of the mixing tube, which actuator can be pneumatically or piezoelectrically activated and deformed. Thereby, a clamping element connected with the actuator is set into a tilting or pivoting movement. The clamping element engages or reaches into the mixing tube, and with its free end clamps the weft thread against a counter support located on the mixing tube. Preferably the embodiment of the actuator is in the form of an elastomeric bellows, which is directly connected with the clamping element. Through varying pneumatic impingement or activation, the actuator can be activated and deformed, whereby a supply line for a separate pneumatic control fluid is provided.

Besides the differing pressure impingement, also the self-elasticity of the actuator embodied as an elastomeric bellows, an adjusting spring, or a flexible elastic holding element can influence the respective position or adjustment of the clamping element. Finally the clamping element itself can be elastically deformed.

The known clamping devices according to the DE 10 2004 036 996 B3 are already built of module units of respectively two clamping devices; in that regard several module units can be combined together into one block. Nevertheless, relatively little space is available for the individual clamping unit. The holding force of a pneumatically actuated holding device is, however, dependent on its structural size. If the dimensions must be small, the holding force is also limited. The same applies for a hydraulic or piezoelectric activation of the actuators. Additionally, in the case of the pneumatic activation, there is still an interfering influence from the compressibility of the controlling airstreams. That leads to a delayed response behavior of the clamping device. It has been determined, that the clamping element is set into oscillations during the transition from its clamping position into the release position and vice versa, whereby especially fine weft threads are no longer reliably and timely clamped. The delayed response behavior of the clamping devices can already lead to interferences in the weaving process at the rotational speeds of up to 1000 rpm that are typical today in modern weaving machines.

A further pneumatically activated clamping device for holding weft threads on jet weaving machines is known from the JP 2000-119 936 A. There, the clamping element is located similarly like a non-return one-way flap at the outlet of the mixing tube, where it is pivotably secured on a joint located externally on the mixing tube, and is pulled into the outlet opening of the mixing tube by a tension spring that is similarly located externally. In that regard, a weft thread is clamped against a shoulder that forms a part of the outlet opening. The blown air stream of the main blow nozzle that introduces or inserts the weft thread shall open the clamping element against the spring effect and thereby release the clamped weft thread. In this known clamping device, an exact, quickly progressing and exactly controllable transition from the clamping position into the release position cannot be expected, because the control of the clamping element is inseparably associated with the transport of the weft thread.

SUMMARY OF THE INVENTION

It is the underlying object of the invention, to provide a method and a clamping device of the above initially mentioned type, with which a reliable holding force in connection with an exact response behavior can be achieved, with a simple compact construction, so that a nearly interference-free weaving operation becomes possible even at high rotational speeds of the weaving machine.

The solution of this object is achieved according to the invention with respect to the method, and with respect to the clamping device, and with respect to a jet weaving machine that comprises the inventive clamping device. A preferred embodiment of the invention is directed to a clamping arrangement including two clamping devices on an air-jet weaving machine, which comprises respectively for each clamping device at least one main blow nozzle with a mixing tube for the insertion of a weft thread into a loom shed by a transport fluid ejected from the main blow nozzle, and an actuator arranged outside of the mixing tube, and a movable clamping element, which, through activating of the actuator, is selectively brought into a clamping position in which the weft thread is tightly clamped on a path location of the main blow nozzle and the mixing tube, or into a release position in which the weft thread is not clamped, and is held in the respective position, characterized in that the clamping arrangement further comprises at least one holding magnet (11), and each respective said clamping element (7) is at least area-wise embodied ferromagnetically, and is arranged so that a clamping force of the respective clamping element (7) in the clamping position thereof is magnetically strengthened by an influence of the holding magnet, characterized in that the two clamping devices (5) with the two mixing tubes (2) lying directly next to one another are combined together to form thereof a module unit (18), whereby the two mixing tubes (2) lie in one plane in a mirror-symmetrical arrangement with the actuators (6) facing outwardly, and characterized in that said holding magnet is a common holding magnet (11) that is allocated to the two mixing tubes (2) of the module unit (18).

Thus, according to the invention an increase or strengthening or reinforcement of the clamping force of the movable clamping element is achieved by an additional magnet force. Because the holding and clamping force is essentially applied by the magnet force, the structural components for the activation of the clamping device can be dimensioned smaller despite a sure or secure functioning. Thus, an especially compact construction becomes possible, so that the main blow nozzles and the mixing tubes can be advantageously arranged, and the straightest possible weft thread guidance is ensured all the way into the weft insertion channel of the weaving read. The magnitude of the strengthening or increasing magnet force is advantageously adapted to the characteristics of the weft thread, so that an additional clamping is ensured without significantly impairing the quality of the weft thread at the clamping location.

According to a first further development of the method, the magnetic increase or strengthening is embodied in such a manner so that the loosening or releasing of the movable clamping element out of its clamping position is at first hampered or checked, but its approach to the clamping position is accelerated.

In a further advantageous embodiment of the inventive method, the holding force of the movable clamping element is magnetically strengthened or increased also in its release position. If further measures are carried out for that purpose, so that the loosening or releasing of the clamping element out of its release position is at first hampered or checked, but its approach to the release position is accelerated, then thereby overall the dynamic behavior of the clamping element in the mixing tube is very advantageously influenced.

Namely, the magnet force acts so long on the clamping element in the respective first end position, until the actuating or positioning force arising from the actuator is built-up on the clamping element, and is larger than the attractive magnet force. When this point is reached, then the clamping element goes over into the second end position in a nearly stroke-like or punch-like manner. Similarly during the approach toward the respective second end position, an acceleration is achieved by the attractive magnet force.

Both effects together reduce the switch-over time that is needed to move the clamping element out of the release position into the clamping position and vice versa. The dynamics of the clamping device are thereby increased. While with a purely pneumatically activated clamping device the time behavior of the clamping element qualitatively corresponds approximately to a cosine curve, a temporal compression or squeezing-together of this process in the direction toward the ideal vertical is achieved due to the strengthening magnet forces. It has been determined that the tendency or susceptibility of the clamping element to following or tracking oscillation or vibration after a position change has been largely reduced. Thereby predominantly, thin weft threads to 0.02 mm can be reliably clamped.

The method can be carried out in that the actuator is hydraulically or piezoelectrically activated. It is especially preferred, however, to activate the actuator by means of a separate pneumatically acting control fluid.

The magnetic strengthening in the clamping position and/or the release position of the clamping element can be achieved permanent-magnetically in an especially simple manner.

In that regard, according to a further preferred embodiment of the method, for certain applications, the permanent-magnetic strengthening is temporarily counteracted or cancelled by a controlled electromagnet. In this manner, for example, the releasing force for the releasing of the clamping element out of its end positions can be reduced or canceled in a controlled manner, and the clamping device can be operated with a pressure that is again lower.

Especially multi-faceted control possibilities for the inventive method arise if the magnetic strengthening is produced by at least one electromagnet, according to a further advantageous embodiment. The control of the electromagnet or electromagnets is then incorporated in the control of the weaving machine. In this manner, for example, the clamping force can be adjusted to changed yarn characteristics or operating conditions or requirements during operation. If, for example, a sensitive weft yarn is being processed, then the magnet force of the electromagnet and therewith the clamping force of the clamping element can be adjusted to a lower value, and damages of the weft yarn at the clamping location are avoided. Robust yarns with a smooth surface can be processed with a high clamping force, so that it is ensured that the yarns are securely held despite the smooth surface. Additionally, the timely or temporal occurrence of the magnet force can be adapted to various different operating conditions such as, e.g. different rotational speeds of the weaving machine.

The especially compact embodiment of the associated clamping device that has become possible through the invention makes it possible to carry out the magnetic strengthening of the clamping element at every location of the main blow nozzle and the mixing tube. An especially advantageous possibility is that, however, the weft thread is clamped in the mixing tube, as that is known from the above initially mentioned DE 10 2004 036 996 B3.

The same advantages apply for the inventive clamping device as for the method.

Also, for the inventive clamping device it is provided as an advantageous further development, that the magnetic strengthening occurs through at least one holding magnet in cooperation with the clamping element not only in the clamping position but also in the release position of the clamping element.

For the constructive or structural embodiment of the inventive clamping device, fundamentally all of the manners of construction that are already set forth in the DE 10 2004 036 996 B3 come into consideration. Especially preferred, however, is the embodiment with a pneumatically activated actuator, whereby this actuator is embodied as an elastomeric bellows, which is pneumatically activated by over-pressure, pressure compensation relative to the surrounding environment, or under-pressure, and is deformed, and is connected with the clamping element in such a manner so that the pneumatic deformation of the elastomeric bellows causes a tilting or pivoting movement of the clamping element for the transition from the clamping position into the release position or vice versa. In that regard, advantageously the clamping element can be directly secured on the elastomeric bellows. Because the actuator embodied as an elastomeric bellows is re-shaped or deformed by air as the activating medium, this gives rise to the tilting movement of the clamping element. In that regard, the tilting movement is hampered or checked by the magnet force during the releasing of the clamping element out of the clamping position or the release position, and is accelerated by the magnet force during the approach of the clamping element to the respective opposite position.

In connection with an actuator in the form of an elastomeric bellows, the strengthening magnet force has an especially advantageous effect, because not only delays or timelags are prevented that are caused by the compressibility of the air. Moreover, also delays or timelags are prevented that are necessitated by the resistance with which the elastomeric bellows opposes the pneumatic activating force during its deformation. Additionally to that, such an elastomeric bellows will be deformed in at least one end position, and therefore in this end position a counter force will continuously oppose the clamping or holding force; because the elastomeric bellows is urged to return to its undeformed initial form. The installation of the holding magnets effectuates that the clamping element is surely or securely held in one of the end positions even in the pressure-free state. Thereby, for example, it is ensured in the release position, that the clamping element does not hinder or block the free through-passage through the main blow nozzle and the mixing tube, because it is always held outside of the transport airstream by the magnet force.

Further embodiments are contained in the remaining dependent claims directed to the clamping device. Thereby further advantages are achieved.

If the clamping element is arranged at one location of the mixing tube and the actuator is located outside on the mixing tube, thereby there arises a compact construction in which on the one hand the main blow nozzles and the clamping devices respectively can be combined together in a block-wise manner. In the constructive embodiment in detail, in that regard the detail solutions already described in the DE 10 2004 036 996 B3 can be advantageously taken over.

For example, the division of the mixing tube into a longer beginning section and a significantly shorter end section is not perhaps only an emergency or protective solution that shall enable the reaching-in or engagement of the clamping element into the mixing tube. Above all, the significantly shorter end section of the mixing tube effectuates that the free end of the weft thread cannot collide with the clamping device and therefore also does not rebound or fold back after the cutting-off of the inserted weft thread section. Thus, a decoupling of the clamping device from the thread end is achieved by the division of the mixing tube.

The arrangement of respectively two clamping devices with mixing tubes lying directly next to one another as one modular unit in a first plane not only achieves the advantage of the compact construction, but rather makes it possible additionally, that for every two clamping devices at least one holding magnet can be used in common; because mainly the module unit that is known and taken over from the DE 10 2004 036 996 B3 leads to the result that beginning and end sections of the mixing tube extend closely neighboring and mirror-symmetrically relative to one another.

The actuators are provided outside on the mixing tube sections; therefore a holding magnet lying between the mixing tube sections of both clamping devices can be effective for both clamping devices in the given case.

BRIEF DESCRIPTION OF THE DRAWINGS

Next the invention will be explained still more closely in an example embodiment in connection with the Figures. The following is illustrated in the drawings.

DETAILED DESCRIPTION OF AN EXAMPLE EMBODIMENT OF THE INVENTION

Figure 1:
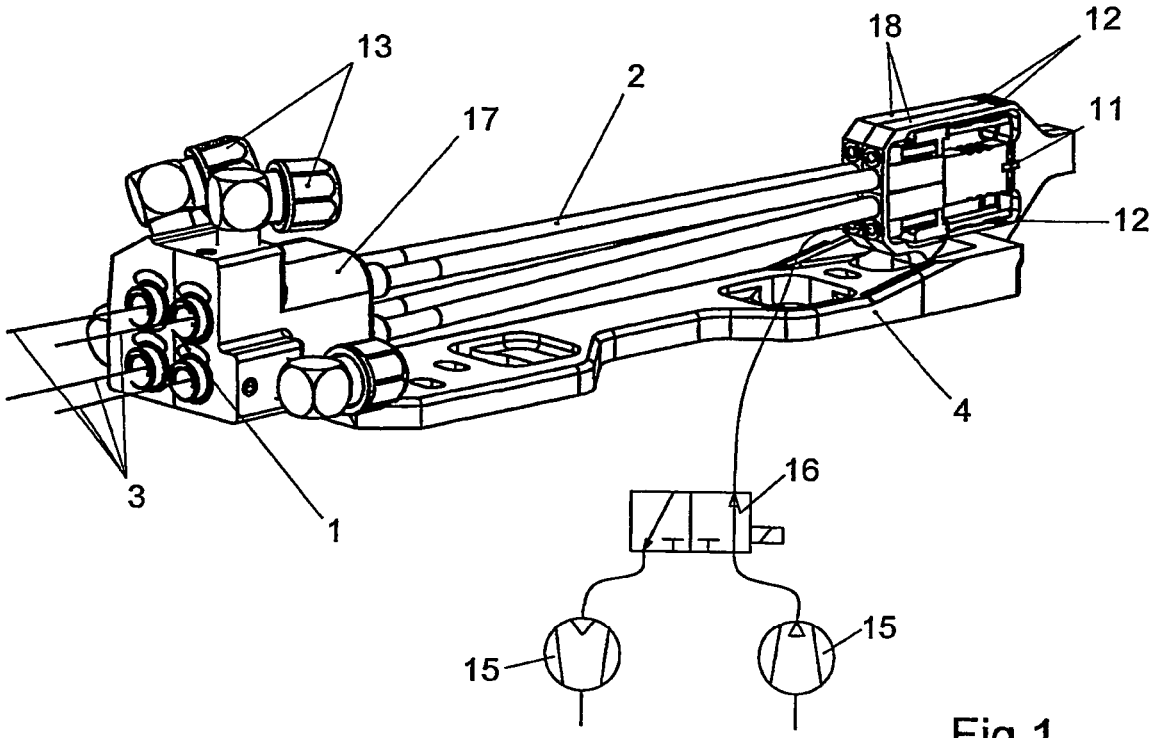
FIG. 1 shows an apparatus for inserting four weft threads, which operates according to the inventive method and includes clamping devices embodied according to the invention.

FIG. 1 shows, as an example from a jet weaving machine, a block 17 with four main blow nozzles 1 onto which the mixing tubes 2 adjoin. Compressed air, which serves for the insertion of the weft threads 3, is delivered via the connections or connectors 13 to the main blow nozzles 1. The illustrated example enables the weaving with four different colors or four different materials of weft threads 3. The weft threads 3 are delivered through the main blow nozzles 1 and passing through the mixing tubes 2 to the weft insertion channel (which is not shown) of a weaving reed, and therewith to the loom shed. The mixing tube 2 is divided into a longer beginning section 2.1 and a relatively shorter end section 2.2. The separation location between the beginning and the end section 2.1, 2.2 is located within the clamping devices, of which a common module unit 18 encompassing four clamping devices is to be seen in FIG. 1.

After the exit out of the end section 2.2 of the associated mixing tube 2, the respective pertinent weft thread 3 comes into the loom shed, is beat-up by the weaving reed against the interlacing point, and is cut-off by a cutter or scissors located between the end section 2.2 and the fabric edge. Before that, however, the weft thread 3 is tightly clamped in the mixing tube 2 by its associated clamping device located in the module unit 18, so that it does not spring back into the mixing tube 2.

The block 17 and the module unit 18 are arranged or mounted on a common base plate 4, which serves for the securing on the loom sley (which is not shown) of the jet weaving machine. Holding magnets, which will be explained later, are referenced with 11 and 12; the same applies to schematically indicated pumps 15 and the valve 16.

Figure 2:
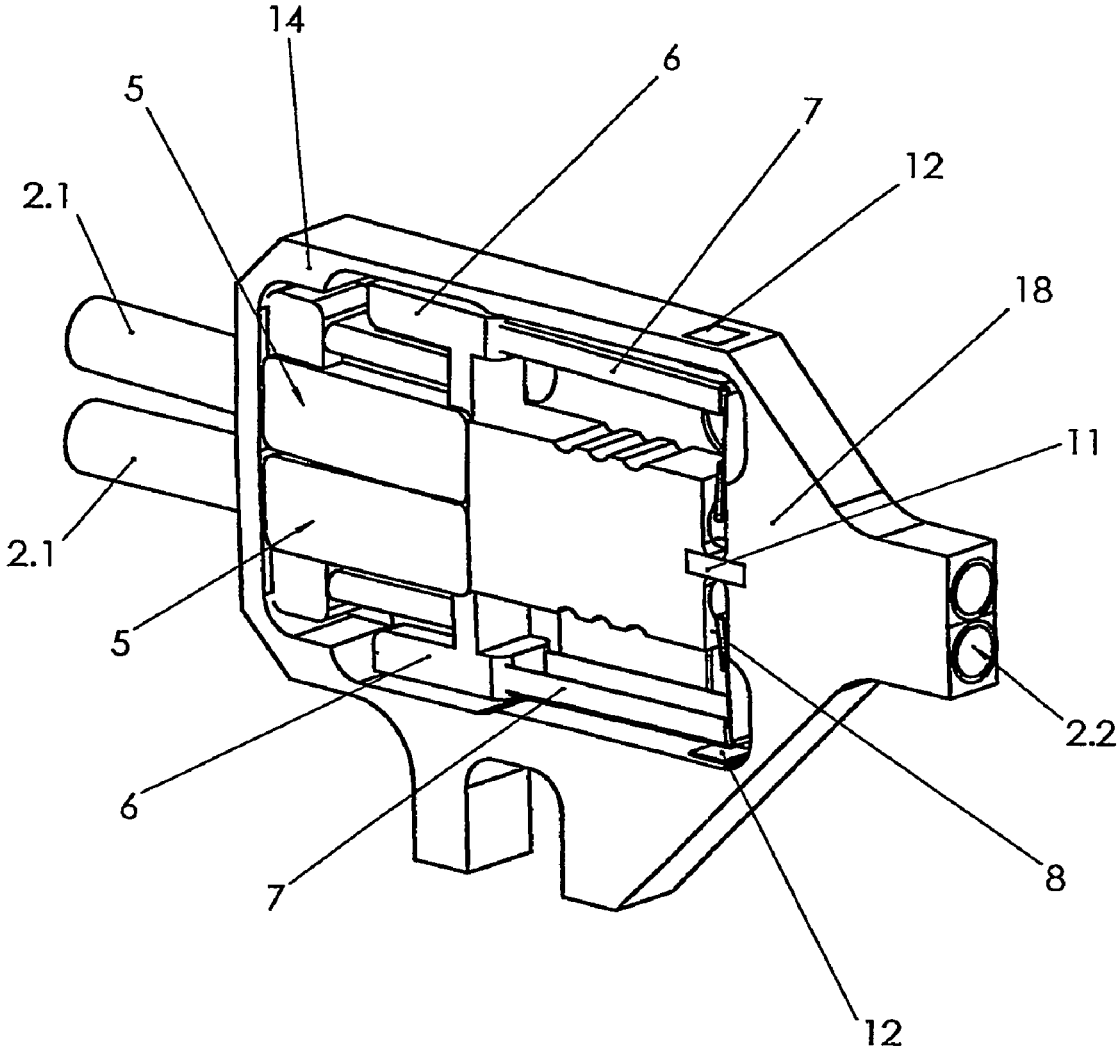
FIG. 2 illustrates a module unit, to which two inventive clamping devices are combined.

In FIG. 2, a single module unit 18 is illustrated spatially and in an enlarged manner. In that regard, two clamping devices 5 are installed over one another and lying tightly against one another in a frame-like carrier 14. The frame-like carrier 14 effectuates that the structural assembly or group of the mixing tubes 2 with the clamping devices 5 is additionally stiffened in the end region or area of the mixing tubes 2. The clamping devices 5 are arranged with end sections 2.2 of the mixing tube 2 lying closely or tightly against one another, whereby the associated actuators 6 lie outside. The clamping devices 5 further have clamping elements 7, which can carry out a tilting or pivoting movement and thereby reach or plunge into engagement openings 8. These separate the beginning sections 2.1 of the mixing tubes 2 from their end sections 2.2. The already mentioned holding magnets are referenced again with 11 and 12. The basic construction of the clamping devices 5 with all details and in various different variants can be seen or taken from the DE 10 2004 036 996 B3 of the applicant. The embodiments shown there are entirely also suitable for the present invention with magnetic strengthening of the holding force. An embodiment serving simply as an example for this can be seen or taken from the FIG. 3 described in the following.

FIG. 3*a* shows a clamping device 5 according to the invention in the release position of the clamping element 7, in which the weft thread 3 is not clamped. An actuator 6, which is embodied as an elastomeric bellows with a chamber 10, is located outside or externally on the beginning section 2.1 of the mixing tube 2. The chamber 10 is connected via a supply line 20 to the valve 16, which is a pneumatic valve in the present example. The control unit (which is not shown) of the weaving machine, controls the electromagnetically activatable valve 16, and can thereby impinge or act on the chamber 10 of the actuator 6 with air, which is under an increased or over-pressure, or which is pressure-less relative to the surrounding environment. The clamping element 7 is connected with the actuator and is embodied as a lever with a long lever arm 7.1 and an angled-off short lever arm 7.2. In that regard, the clamping element 7 is plugged or inserted into a slit that is embodied in the elastically deformable actuator 6. The angled-off short lever arm 7.2 stands opposite an engagement opening 8, which separates the mixing tube 2 into a beginning section 2.1 and an end section 2.2. Beginning section 2.1 and end section 2.2 are connected with one another by a counter support 9. The clamping element consists of a ferromagnetic material. The clamping device 5 further has a contact stop part 19 that can be embodied on the frame-like carrier 14.

A first holding magnet 11 is recessed or let into the counter support 9, and a second holding magnet 12 is recessed or let into the contact stop part 19, for example being cast-in. In the release position according to FIG. 3*a*, the chamber 10 is pressure-less relative to the surrounding environment. The actuator 6 embodied as an elastomeric bellows is therefore in its relaxed or unstressed condition, in which the clamping element 7 connected with it extends parallel to the mixing tube 2, and the weft thread 3 is not clamped. Additionally, the clamping element 7 is held in the release position by the second holding magnet 12.

In FIG. 3*b* the condition is shown in which the chamber 10 of the actuator 6 is fed with air under increased pressure via the valve 16 and the supply line 20. Thereby the actuator 6, which is embodied as an elastomeric bellows, is inflated and deformed. The clamping element 7 connected with the actuator 6 follows the deformation and therefore carries out a tipping or tilting or pivoting movement, whereby it plunges or reaches with its angled-off short lever arm 7.2 into the engagement opening 8 and comes into contact on the counter support 9 in the area of the first holding magnet 11. Thereby the clamping element 7 presses the weft thread 3 onto the counter support 9 with the first holding magnet 11 and holds the weft thread 3 clampingly tight. Thereby the holding force of the first holding magnet 11 strengthens or reinforces the clamping force that is exerted by the pneumatically deformed actuator via the clamping element. The short end section 2.2 of the mixing tube 2 primarily has the function of preventing that the cut-off end of the weft thread 3 collides with the clamping device 5. For each weft thread 3 and thus for each main blow nozzle 1 and each clamping device 5, an individual allocated valve 16 is provided. The activation of the individual valves 16 occurs depending on which weft thread must be inserted just now. Alternatively, with a hydraulically activated actuator, a hydraulic fluid is supplied and removed via the at least one pump 15 and the control valves 16, for activating the actuator.

Figure 3:
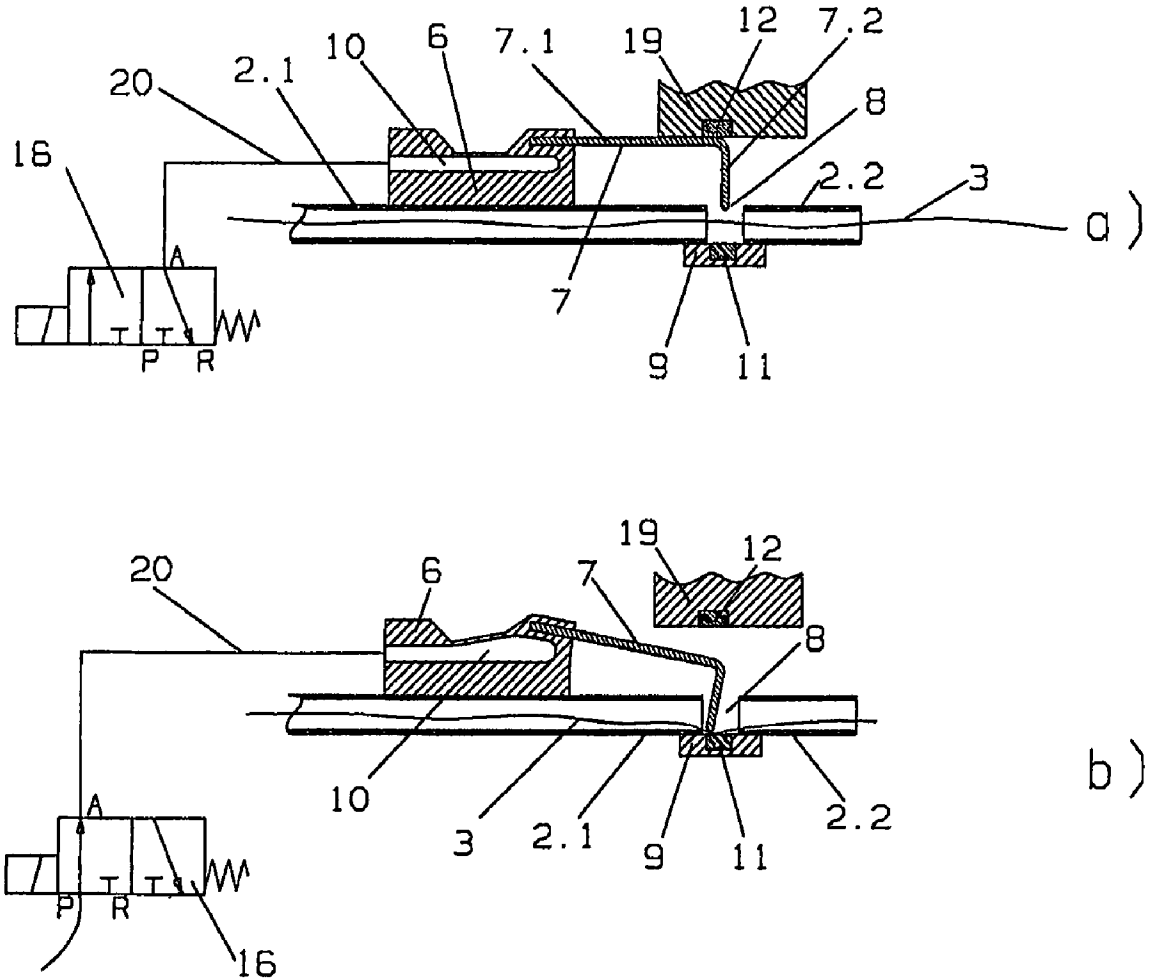
FIG. 3 explains the function of the inventive clamping device, whereby according to FIG. 3*a* its release position, and according to FIG. 3*b* its clamping position, is illustrated.

If two clamping devices 5 illustrated in FIG. 3 are combined together to one module unit 18 according to FIG. 2, the possibility arises of providing, instead of two first holding magnets 11, a single one that holds, in a strengthened or reinforced manner, the clamping element 7 in its clamping position for both clamping devices 5.

The invention claimed is:

1. Clamping arrangement including two clamping devices on an air-jet weaving machine, which comprises respectively for each clamping device at least one main blow nozzle with a mixing tube for the insertion of a weft thread into a loom shed by a transport fluid ejected from the main blow nozzle, and an actuator arranged outside of the mixing tube, and a movable clamping element, which, through activating of the actuator, is selectively brought into a clamping position in which the weft thread is tightly clamped on a path location of the main blow nozzle and the mixing tube or into a release position in which the weft thread is not clamped, and is held in the respective position, characterized in that the clamping arrangement further comprises at least one holding magnet (11), and each respective said clamping element (7) is at least area-wise embodied ferromagnetically, and is arranged so that a clamping force of the respective clamping element (7) in the clamping position thereof is magnetically strengthened by an influence of the holding magnet, characterized in that the two clamping devices (5) with the two mixing tubes (2) lying directly next to one another are combined together to form thereof a module unit (18), whereby the two mixing tubes (2) lie in one plane in a mirror-symmetrical arrangement with the actuators (6) facing outwardly, and characterized said holding magnet is a common holding magnet (11) that is allocated to the two mixing tubes (2) of the module unit (18).

2. Clamping arrangement according to claim 1, characterized in that at least one further holding magnet (12) is provided for cooperating with the clamping element (7) in the release position thereof to provide a strengthened holding effect.

3. Clamping arrangement according to claim 1, wherein the actuator is a pneumatically activated actuator, characterized in that the actuator (6) is embodied as an elastomeric bellows, which can be deformed by a pneumatic control fluid by over-pressure, pressure compensation relative to a surrounding environment, or under-pressure, and which is operatively connected with the clamping element (7) such that a pneumatic deforming of the elastomeric bellows effectuates a tilting movement of the clamping element (7) for moving from the clamping position into the release position or vice versa.

4. Clamping arrangement according to claim 3, characterized in that the clamping element (7) is secured on the elastomeric bellows.

5. Clamping arrangement according to claim 1, wherein the actuator is a hydraulically activated actuator, characterized in that, for activation thereof the arrangement further comprises at least one puma (15) and control valves (16) by which a hydraulic fluid is supplied and removed.

6. Clamping arrangement according to claim 1, characterized in that the clamping element (7) is arranged at a location of the mixing tube (2) and the actuator (6) is located outside on the mixing tube (2).

7. Clamping arrangement according to claim 6, characterized in that the clamping element (7) is embodied as an angled-off lever with a long lever arm (7.1) and a short lever arm (7.2), whereby the long lever arm (7.1) extends in a longitudinal direction of the mixing tube (2) and the short lever arm (7.2) plunges into an engagement opening (8) of the mixing tube (2) for moving into the clamping position and brings the weft thread into contact on a counter support (9) in a clamped-in manner, on which counter support the holding magnet (11) is located.

8. Clamping arrangement according to claim 7, characterized in that the engagement opening (8) of the mixing tube (2) separates the mixing tube into a longer beginning section (2.1) and a significantly shorter end section (2.2), which axially aligns with the beginning section (2.1) and wherein an end of the shorter end section forms an exit or outlet opening of the mixing tube (2), and in that the counter support (9) comprises a contact surface with increased frictional effect, which connects the end section (2.2) with the beginning section (2.1) of the mixing tube (2) and essentially closes the engagement opening (8) on one side.

9. Clamping arrangement according to , claim 1, characterized by a parallel arrangement of up to four of the module units (18), perpendicularly to a plane of each module unit (18) such that a block of up to eight of the mixing tubes (2) and the actuators (6) is formed.

10. Air-jet weaving machine, which comprises a clamping arrangement according to claim 1.

* * * * *

UNITED STATES PATENT AND TRADEMARK OFFICE

CERTIFICATE OF CORRECTION

PATENT NO. : 7,753,084 B2
APPLICATION NO. : 12/227775
DATED : July 13, 2010
INVENTOR(S) : Gielen It is certified that error appears in the above-identified patent and that said Letters Patent is hereby corrected as shown below:

Column 5,
Line 35, after "another." delete the paragraph break;

Column 8,
Line 32, after "one", replace "puma" by --pump--;
Line 59, after "according", replace "to , claim" by --to claim--.

Signed and Sealed this

Thirtieth Day of November, 2010

David J. Kappos

David J. Kappos
*Director of the United States Patent and Trademark Office*